United States Patent [19]

Provost

[11] 4,044,717

[45] Aug. 30, 1977

[54] APPARATUS FOR COATING A SURFACE WITH A PULVERULENT PRODUCT

[75] Inventor: Roger Provost, Louveciennes, France

[73] Assignee: Institut Francais du Petrole, France

[21] Appl. No.: 694,337

[22] Filed: June 9, 1976

[30] Foreign Application Priority Data

June 18, 1975 France ..... 75.19299

[51] Int. Cl.[2] ..... B05B 5/02

[52] U.S. Cl. ..... 118/629

[58] Field of Search ..... 118/DIG. 5, 629, 302, 118/621, 623, 627, 631; 239/15; 427/38, 21, 185; 317/3, 262

[56] References Cited

U.S. PATENT DOCUMENTS

| | | | |
|---|---|---|---|
| 3,347,469 | 10/1967 | Ross et al. | 118/629 X |
| 3,691,991 | 9/1972 | Luderer | 118/629 |
| 3,892,357 | 7/1975 | Tamny | 118/629 X |

*Primary Examiner*—Louis K. Rimrodt

*Attorney, Agent, or Firm*—Craig & Antonelli

[57] ABSTRACT

This apparatus comprises in combination means for processing the pulverulent product, which subject this product to a sudden pressure drop and deliver a pulverulent fluid formed by solid particles of the product suspended in a carrying gas, a storage chamber communicating with said processing means, spraying means connected to said chamber by a pipe and means controlling the flow of pulverulent fluid through said pipe.

27 Claims, 5 Drawing Figures

APPARATUS FOR COATING A SURFACE WITH A PULVERULENT PRODUCT

The present invention relates to an apparatus for coating a surface with a powder or pulverulent product.

The apparatuses used up to now for coating with a pulverulent product the surface of an object comprise devices such as cyclone separators and fluidized bed devices, so that the very fine particles of the pulverulent products are effectively suspended in a carrying gas, such as air. The solid particles forming the pulverulent product are sprayed onto the surface of the object by means of a spraying device, known in the art as "electrostatic spray gun".

These prior art devices are quite convenient for spraying such powders as very fine polypropylene, polyvinyl chloride (P.V.C.), polyamide powders, etc.

However it is very difficult, if not impossible to obtain good results with powders, even if they are very fine, of such fluorinated resins as those commercially available under the registered trade marks ALGOFLON, FLUON, HALON, HOSTAFLON, VOLTALEF, and more particularly TEFLON (polytetrafluoroethylene), since the fine solid particles which form these powders have a high tendency to build agglomerates which are very difficult to disaggregate. Thus the constituted coatings are of irregular thickness and their granulometry is not homogeneous. Moreover, if the spray of pulverulent product is interrupted the particles which are still in the spraying device and its feeding pipe will deposit, thus forming agglomerates which prevent restarting the apparatus. This apparatus has to be disassembled and thoroughly cleaned.

The object of the present invention is to provide an apparatus which does not suffer from the above-indicated disadvantages and makes it possible to form a coating of pulverulent product, even when the solid particles constituting this product have a high tendency to form agglomerates which are difficult to disaggregate.

Figure 1:
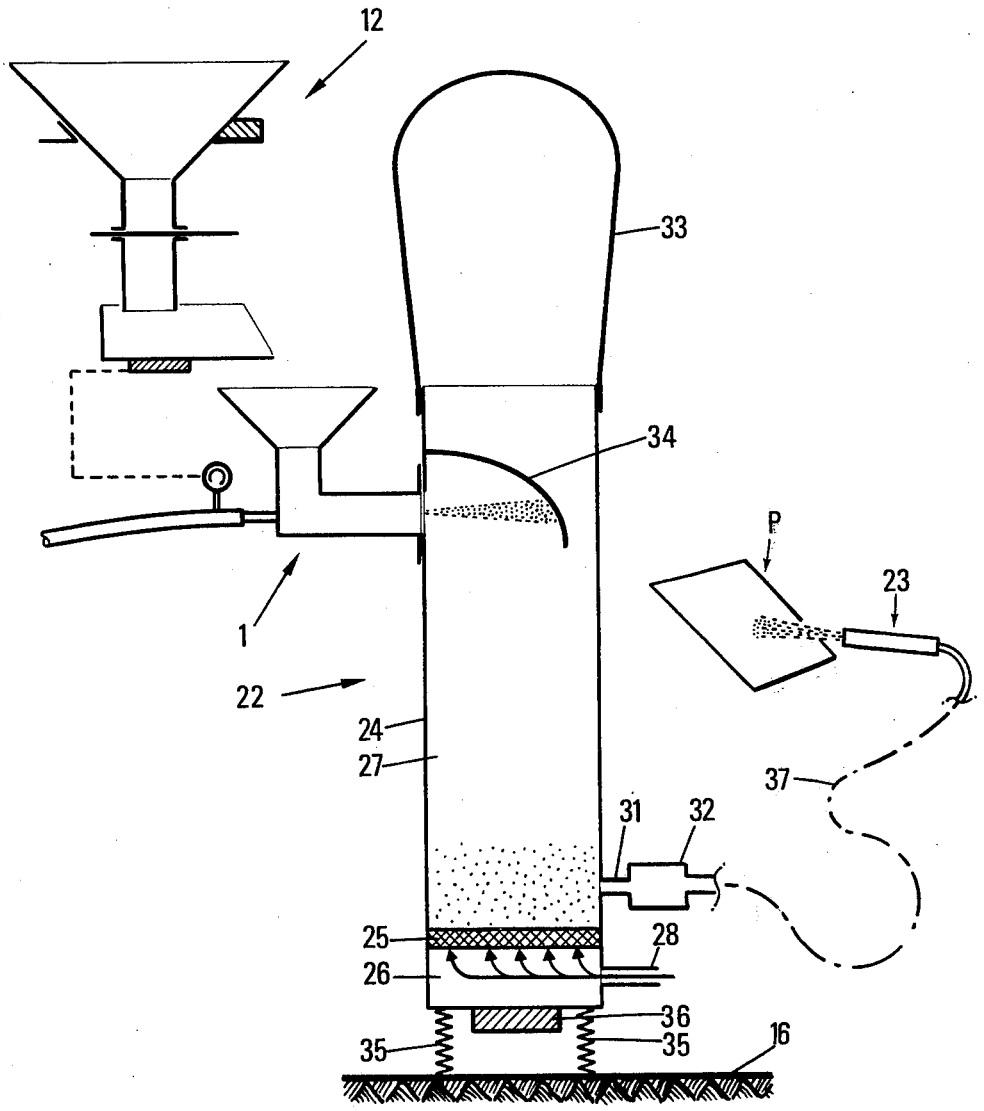
Figure 2:
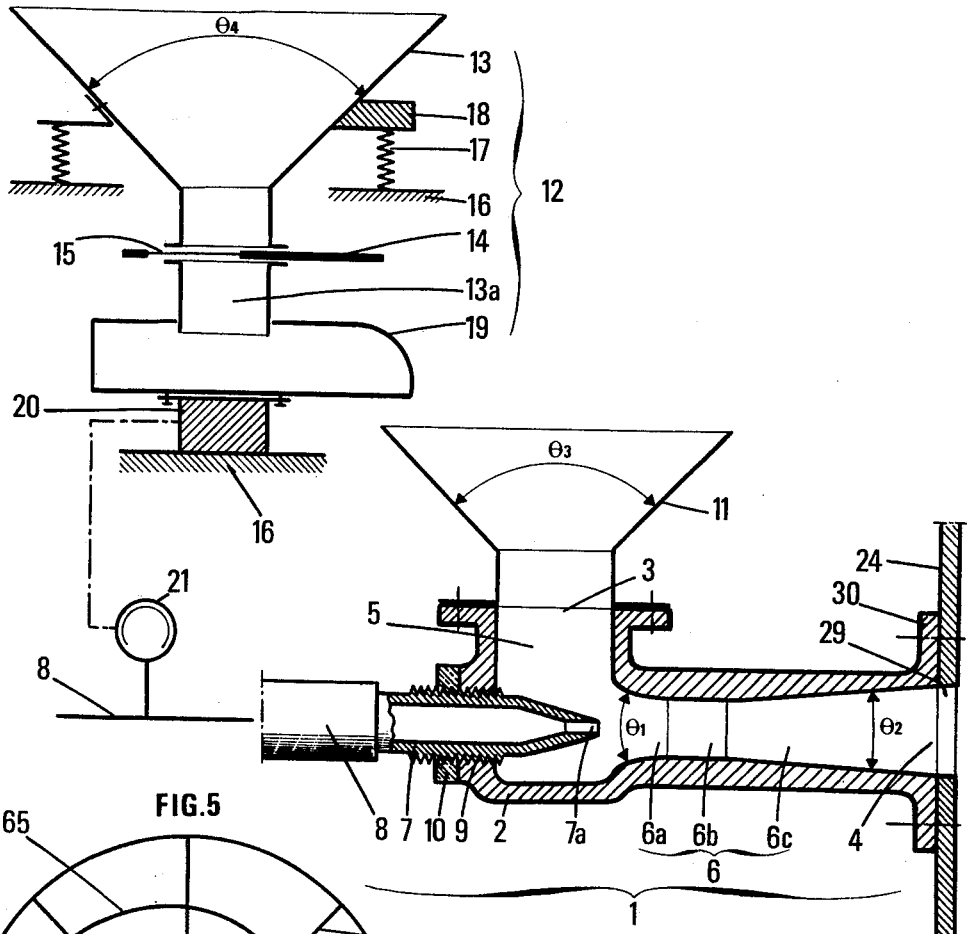
Figure 5:
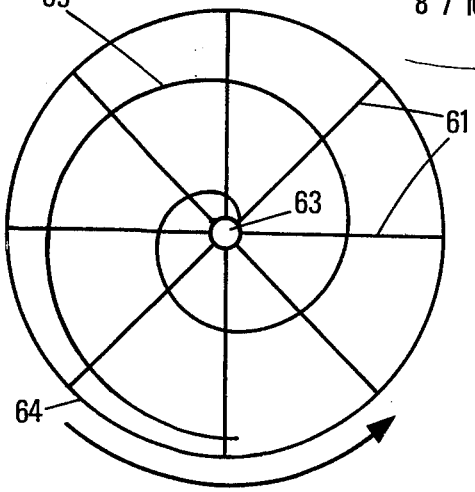
Figure 4:
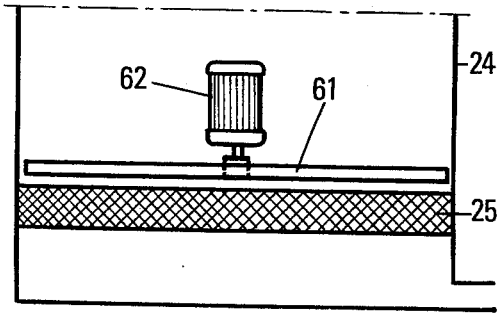
Figure 3:
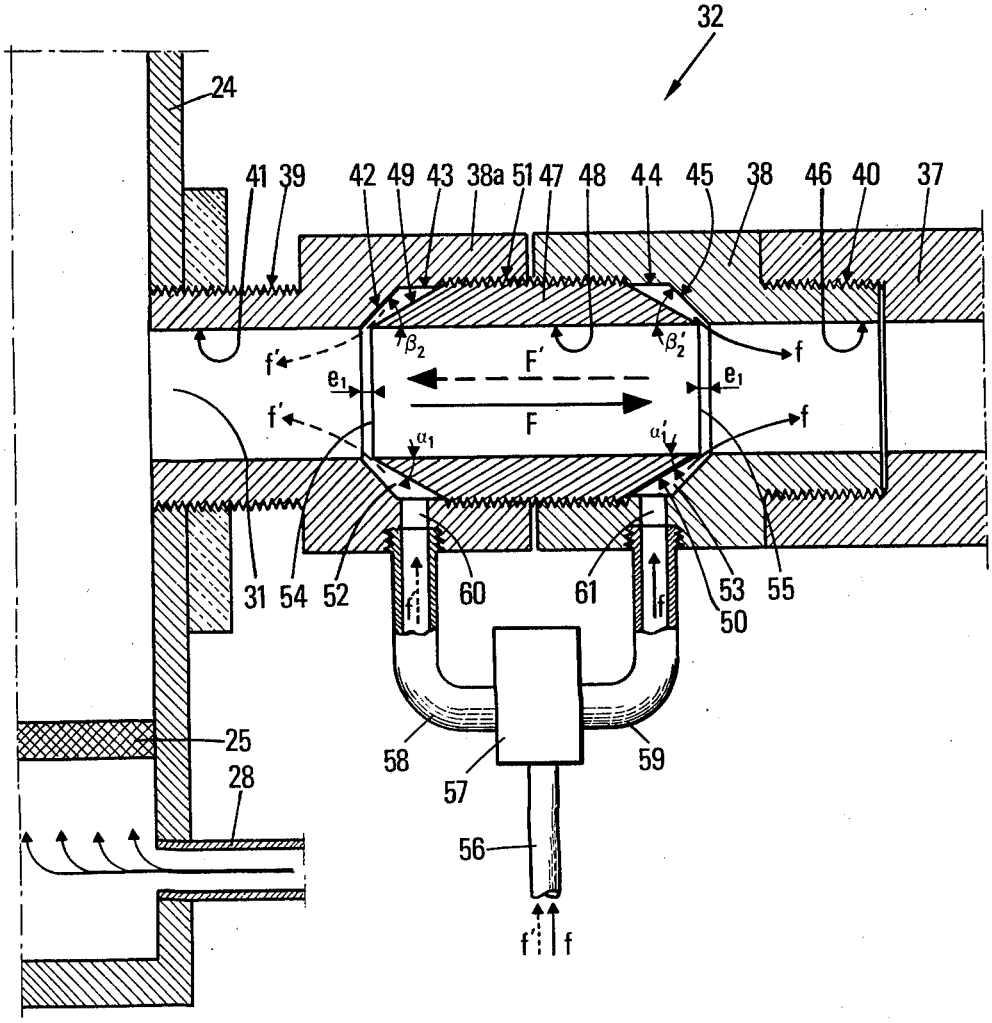

The invention will be understood and advantages thereof made apparent from the following description of a particular non limitative embodiment, illustrated by the accompanying drawings wherein:

FIG. 1 is a diagrammatic cross sectional view of an apparatus according to the invention, FIG. 2 shows more in detail the device for treating or processing the pulverulent product, FIG. 3 illustrates another embodiment of an element controlling the flow of pulverulent product towards the spraying element, FIG. 4 shows an alternative embodiment of FIG. 1, and FIG. 5 illustrates another embodiment of the blades.

To facilitate reading of the following description, there will be contemplated, by way of example only, the case where the apparatus according to the invention is used to form with a TEFLON powder (Registered Trade Mark for polytetrafluoroethylene) a protective coating on a plate such as, for example, a fuel cell electrode.

This plate is indicated by reference P in FIG. 1 which diagrammatically shows the assembly of the apparatus according to the invention.

This apparatus comprises in combination three essential parts whose functions are indicated hereinafter:

the first part, which is fed with the pulverulent product is devised to disaggregate all the agglomerates of solid particles and to supply a pulverulent fluid formed by a carrying gas having the solid particles suspended therein, this first part comprises a conditioning element designated as a whole by reference 1 the second part is intended to store the pulverulent product and to prevent clogging of the solid particles; this second part comprises a chamber, designated as a whole by reference numeral 22, communicating with element 1, and the third part comprising element 23 is devised to spray the solid particles of pulverulent product onto the surface of the object P (which forms no part of this invention).

Optionally an element 12 will feed the apparatus with pulverulent product which in most cases takes the form of agglomerates.

FIG. 2 is a vertical cross sectional view of treating or processing means fed with pulverulent product, which in this particular embodiment is a TEFLON powder (Trade Mark for polytetrafluoroethylene). These means are adapted to subject the pulverulent product to a sudden pressure drop, since the inventor has ascertained that under such conditions the formed agglomerates are nearly instantaneously disaggregated, even when the pulverulent products are made of powders of fluorinated resins.

The treating or processing means comprise a body member 2, having an inlet opening for the agglomerates to be disaggregated and an outlet opening 4 for the resulting pulverulent fluid.

The opening 3 communicates with a chamber 5 provided in body member 2. This chamber 5 communicates with the outlet opening 4 through a pipe 6 which comprises successively a convergent section **6*a*, a cylindrical section 6*b* and a divergent section 6*c*. An injector 7, connected to a source of pressurized gas through a pipe 8, has one end provided with a calibrated aperture 7*a* located in chamber 5. This injector forms, together with pipe 6, a suction nozzle of the VENTURI type which, when the injector 7 is fed with pressurized gas, creates a negative pressure in chamber 5**.

The characteristics of the VENTURI may be identical to those of the Venturis which are conventionally used in other fields. For example, the apex angle $\theta_1$ of section **6*a* will have a value close to 30°, while the apex angle $\theta_2$ of section 6*c* will have a value close to 6°. Preferably the position of injector 7 coaxial with pipe 6 will be ajustable, for example through threading 9, while injector 7 can be held stationary in the selected position through a tightening screw 10. Optionally the introduction of the TEFLON agglomerates may be facilitated through a guiding device 11 secured to body member 2, above and in the extension of the inlet opening 3**, this device having the shape of a frustum with an apex angle $\theta_3$ preferably not greater than 90°.

It will be preferable to use an injector 7 whose end located inside chamber 5 is of the smallest possible size and whose outer surface, as well as the wall of chamber 5, does not show any asperity. Moreover the profiles of chamber 5 and pipe 6 should not exhibit any acute angle since experience have shown that clogging of pulverulent products had a tendency to occur at the location of asperities, or acute angles.

The apparatus according to the invention may optionally comprise automatic means for feeding the element 1 with agglomerates of pulverulent products.

These automatic feeding means are indicated as a whole by reference numeral 12 and comprise, for example, a hopper 13 devised to receive the TEFLON agglomerates which must be powdered. This hopper has for example the shape of a frustum with an apex angle $\theta_4$ whose value is preferably at most equal to 90°. The hopper 13 provided with an element for regulating the outlet orifice 13*a* permitting control of the flow rate of the product to be processed which flows from the hopper. In FIG. 2 this element, which may be of any known type, has been illustrated in the form of a slide valve 14 provided with an aperture 15, the position of the slide, uncovering a greater or smaller section of the lower opening of the hopper. This hopper is connected to the frame of the diagrammatically illustrated apparatus 16 through resilient means constituted by springs, elastomer blocks, etc. The hopper 13 is provided with a vibrating element 18 capable of imparting vibrations to this hopper in a direction having a component along the direction of flow of the processed product towards the hopper 13.

This vibrating element 13 may be of any suitable known type comprising, for example, an electro-magnet, or a rotary element which is dynamically unbalanced, or also a heavy ball displaced by a pressurized gas along a determined path.

Below hopper 13 is located an element conveying towards element 1 agglomerates which have flowed from hopper 13. Preferably displacement of the agglomerates is achieved by vibrations of the transfer element 19. Such vibrations of adjustable amplitude have a component oriented along the direction of displacement of the agglomerates to be processed and are created by a vibrating element 20 integral with element 19. The vibrating element 20 may be of any known convenient type, comprising for example an electro-magnet, etc.

A device 21 of the pressostatic type, connected to pipe 8 feeding injector 7 with pressurized gas, permits control of the vibrating element 20 and optionally of the vibrating element 18, exclusively when injector 7 is effectively fed with pressurized gas. However one would not depart from the scope of the invention by using a device 21 allowing actuation of element 20 exclusively when pressure in chamber 5 has reached, while decreasing, an adjustable predetermined value.

The storing chamber 22, diagrammatically illustrated in FIG. 1, is made of a tank 24 having a porous wall 25 which delimits a lower compartment 26 and an upper compartment 27.

The lower compartment 26 communicates through a pipe 28 with a source of pressurized gas, such as pressurized air.

The upper compartment 27 comprises an inlet orifice 29 (FIG. 2) communicating with the outlet opening of the treating means 1. In the illustrated embodiment, the latter are directly secured to the outer wall of tank 24 through any known means such as by fastening flanges 30 integral with element 1. The upper compartment has also an outlet orifice 31 provided with an element 32 controlling the flow of pulverulent product. Moreover a section 33 of the tank wall delimiting compartment 27 is permeable to gas. This wall section is preferably located at the upper part of compartment 27. In the embodiment illustrated by FIG. 1, the wall section 33 has the shape of a flexible sleeve made of a fabric of silicone Tergal (Registered Trade Mark).

A deflector 34 is optionally located in compartment 37 to direct the spray of pulverulent fluid towards the porous separating wall 25.

The storing element 22 is connected to the frame, diagrammatically indicated at 16, through resilient elements such as springs, or blocks made of a resilient material.

A vibrating element 36 which may be of any known type is fixed to tank 24, this element being for example similar to the above mentioned vibrating elements 18 and 19, so as to impart to tank 24 a vibrating motion having a vertical component.

The outlet orifice 31 is connected through control element 32 and a pipe 37 to the spraying element which need not to be described in detail and may be of any known suitable type. For example element 23 may be a device known in the art as "electrostatic spray gun" (commercialized by SAMES, RANSBURG, etc.) and adapted to electrically load the solid particles of the pulverulent product, owing to an electrostatic generator (not shown) to which this gun is connected.

As already pointed out, the flow of pulverulent fluid through pipe 37 is controlled by device 32 preferably located between tank 24 and pipe 37.

A particular, though non-limitative, embodiment of this device is shown in cross section in FIG. 3. It comprises a tubular body member which, in this embodiment, is shown in two parts 38–38*a*. This body member is provided at each end with connecting means 39–40 which may be of any known type, and which are shown in FIG. 3 in the form of threadings, enabling connection of the device both with tank 24 and with one end of pipe 37.

Considering the direction of flow of the pulverulent product from tank 24 to pipe 37, the internal bore of body member 38–38*a* comprises successively a cylindrical part 41, a diverging conical part 42 having an apex angle $2\ \beta_2$, a cylindrical part 43–44 of greater diameter than part 41, a converging conical part 45 having an apex angle $2\ \beta'_2$ and a cylindrical part 46 of lower diameter than part 43–44. The cylindrical parts 41 and 46 have preferably a diameter substantially equal to the internal diameter of pipe 37.

In the central part of the bore of body member 38–38*a*, located between the conical parts 42 and 45, is positioned ring 47 having an internal bore 48 of cylindrical shape and of the same diameter as bores 41 and 46. The ends 49–50 of the ring 47 have conical outer surfaces, with apex angles $2\ \alpha_1$ and $2\ \alpha'_1$ which are respectively smaller than the apex angles $2\ \beta_2$ and $2\ \beta'_2$ of the conical bores 42 and 45.

The ring 47 is made integral with body member 37–38, for example by threadings 51, and delimits in the central part of the internal bore of the body, comprised between the cylindrical bores 41 and 46, annular spaces 52–53 having no direct communication with each other but each of which opens in the cylindrical bore of body 37–38 through annular slots 54–55 having the respective widths $e_1$ and $e'_1$.

A (not illustrated) source supplying a gaseous auxiliary fluid, such as pressurized air, is connected to each of the annular spaces 52, 53, through a pipe 56, a distributing element 57, pipes 58–59 which communicate respectively with apertures provided in body member 37–38 and opening in the annular spaces 52–53.

The element 57 may be of any known type adapted to put pipe 56 in communication with only one of either pipes 58 and 59. This element may for example be constituted of two electrovalves with separate control, or also of an electrical three way-two position-distributor, etc.

Thus each of the annular spaces fed with pressurized gas constitutes an injector capable of circulating the auxiliary fluid through body member 38–38*a* with a direction of flow so determined as to create a negative pressure in this body member.

The operation of the apparatus is as follows:

Pressurized air is introduced into tank 24 through pipe 28 (FIG. 1) and flows successively through the porous walls 25 and 33, flowing vertically and upwardly. Simultaneously the device 36 is energized so as to vibrate tank 24. Then the vibrating element 18 (FIG. 2) is actuated and the TEFLON agglomerates to be disaggregated are placed in the hopper 13. The injector is fed with a gas such as air whose pressure and flow rate are regulated so as to create in chamber 5 a negative pressure at least 0.2 bar below atmospheric pressure. The vibrating element 20 is in turn actuated and so adjusted as to generate vibrations of predetermined amplitude. The operator moves the slide 14. The TEFLON agglomerates flow into element 19 and are conveyed to the guiding cone 11. They fall by gravity into chamber 5 where they are subjected to the action of the negative pressure prevailing in this chamber, which causes disaggregation of the agglomerates. There is thus obtained at the outlet of the device 1 a pulverulent product formed of TEFLON particles suspended in air. This pulverulent product enters tank 24. The upwardly flowing air introduced into tank 24 exerts an action opposed to that of gravity on the fine TEFLON particles which then remain suspended in air to form above the porous wall 25 what is known as a "fluidized bed" of fine solid particles.

To control the flow of pulverulent product through pipe 37, the operator actuates the distributor element 57 (FIG. 3), so that the gaseous auxiliary fluid feeding pipe 56 flows exclusively in the direction indicated by the arrows *f* through pipes 59 and 61 then into the annular space 53 and thereafter through the bore 46. This auxiliary fluid creates in device 32 a negative pressure capable of sucking and displacing in the direction of arrow F the pulverulent fluid contained in tank 24.

Through the electrostatic gun 23 the TEFLON particles are sprayed onto plate P (FIG. 1) to form a homogeneous layer of uniform thickness.

The flow of pulverulent product from tank 24 to pipe 37 is interrupted by actuating the distributor element 57 (FIG. 3) so that feeding of annular space 53 with auxiliary fluid is interrupted and this auxiliary fluid flows exclusively along the path indicated by arrows *f'*, i.e. through pipes 58 and 60, annular space 52 and then through bore 41, thus creating in the device 32 a negative pressure capable of displacing the pulverulent fluid contained in pipe 37 and device 23 in the direction indicated by the arrow F', i.e. from pipe 37 to tank 24. It results from the foregoing that not only the device 32 permits control of the flow of pulverulent fluid through pipe 37, but that, when this flow is interrupted, pipe 37 and device 23 are cleared of the volume of pulverulent product which they contain, thus preventing formation of agglomerates on the inner wall of the pipe, which could result from a deposition of TEFLON particles forming this pulverulent product.

The characteristics of the apparatus according to the invention will be determined in accordance with the use of this apparatus.

In practice, the operator knows the flow rate of pulverulent product at the outlet of the projecting element 23 and will fix accordingly the flow rate of pulverulent product at the outlet of element 1. He will adjust the position of slide 14 (FIG. 2), the amplitude of the vibrations of the transfer element 19 and the value of the negative pressure prevailing inside chamber 5. This value will be the lower as the flow rate of agglomerates to be disagreggated is higher.

The value of the negative pressure inside chamber 5 is adjusted by varying the location of injector 7 in chamber 5 and adjusting the flow rate and pressure of the air feeding the injector.

The operator will generally effect the adjustment which corresponds to a minimum consumption of the air feeding the injector.

Obviously the adjustment may vary in dependence with the size of the agglomerates to be treated, but it will be possible to mechanically treat the agglomerates prior to their introduction into hopper 13, so that their size do not exceed a predetermined value.

The size of tank 24 will be fixed in dependence with the volume of pulverulent fluid to be stored. The porosity of the separating wall 25 and that of the wall portion 33 will be so selected as to minimize pressure drops through these walls. The pressure of the air introduced into compartment 26 is so adjusted that the pressure within compartment 27 be as close as possible to the pressure prevailing outside tank 24, and the air flow rate is so selected as to prevent particles to be deposited within tank 27. The operator will preferably so adjust the values of pressure and flow rate that when the above conditions are complied with, the consumption of the air feeding compartment 26 is reduced to a minimum.

The operator will also select the characteristics of the element 32 which controls the flow of pulverulent product (FIG. 3), such as $\alpha_1$, $\alpha'_1$, $\beta_2$, $\beta'_2$, the pressure and and flow rate of the auxiliary fluid, etc.

By way of example, in the case of a pipe having an inner diameter of 14 mm, to control the flow of a pulverulent product comprising very fine particles of polytetrafluoroethylene (PTFE) suspended in air at a pressure substantially equal to atmospheric pressure, the selected auxiliary fluid was air at a pressure of 1.1 bar with $\alpha_1 = \alpha'_1 = 30°$, $\beta_2 = \beta'_2 = 45°$, $e_1 = e'_1 \simeq 1$ mm.

The processing means 1, tank 24 and control element 32 will advantageously be fed with air whose temperature and relative humidity, as well as the temperature and relative humidity of the surrounding air have determined values such as those recommended by the manufacturer of the pulverulent product. To this end the apparatus (through this is not shown on the drawing) may be, if necessary, located in a chamber or a room whose atmosphere is conditioned.

In the case where the apparatus is used for forming coatings of PTFE, the inventor has ascertained that the air feeding the apparatus should have a relative humidity at most equal to 50% and such a temperature that the temperature of the TEFLON which forms the pulverulent product be at most equal to 19° C.

Very good results have been obtained at a temperature of 4° C, with a relative humidity of air close to 30%.

Changes may be made without departing from the scope of the present invention.

For example if tank 24 is of very big size it may be constituted by several parts connected to one another through a deformable element, each of these parts being provided with a vibrating element.

In the case where pipe 37 is of great length, it will be possible to use several control elements 32 having different locations on the pipe and which may be automatically controlled in synchronism.

It will be also possible to omit the vibrating device 36 and to place just above the porous wall 25 one or several rotating blades 61 (FIG. 4) driven by a motor 62 which rotates at a small speed, such a blade preventing formation of preferential channels for the air flowing through the fluidized bed.

FIG. 5 shows by way of example an assembly of blades 61 secured to a hub 63 and connected to one another by a ring 64. In this embodiment a spiral 65 is associated to the blades 61 and favours concentration of the fluidized bed in the central part of tank 24.

What I claim is:

1. An apparatus for depositing a homogeneous layer of a pulverulent product onto the surface of an object, comprising in combination:

treating means for subjecting the pulverulent product to a sudden pressure drop to produce a pulverulent fluid containing solid particles of the pulverulent product suspended in a carrier gas, a storage chamber for receiving the pulverulent fluid, said chamber communicating with said treating means, means for spraying said particles of the pulverulent fluid, said spraying means being connected to said chamber through a conduit, and means controlling the flow of pulverulent fluid in said conduit.

2. An apparatus according to claim 1, wherein said spraying means includes means for loading the solid particles of the pulverulent product with static electricity.

3. An apparatus for depositing a homogeneous layer of a pulverulent product onto the surface of an object, comprising in combination:

treating means for subjecting the pulverulent product to a sudden pressure drop to produce a pulverulent fluid containing solid particles of said pulverulent product in a carrier gas, said treatment means comprising a member delimiting a chamber, an inlet opening for entry of the pulverulent product into said chamber and an outlet opening for the discharge of the pulverulent fluid from said chamber, and suction means for creating in said chamber a negative pressure with respect to the pressure prevailing outside said chamber a storage chamber means for receiving the pulverulent fluid, said chamber means communicating with said treating means, means for spraying said pulverulent fluid onto an object, said spraying means being connected to said storage chamber means through a conduit, and means for controlling the flow of said pulverulent fluid through said conduit.

4. An apparatus according to claim 3, wherein said suction means creates in said chamber a pressure at least 0.2 bar lower than the pressure prevailing outside said chamber.

5. An apparatus according to claim 4, wherein said suction means comprise a cylindrical element connecting said chamber to said outlet opening.

6. An apparatus according to claim 5, wherein said cylindrical element comprises a venturi and an injector fed with pressurized gas, said injector having a calibrated aperture located outside said chamber, substantially along the axis of said venturi.

7. An apparatus according to claim 6, wherein said injector is adjustably secured to said member.

8. An apparatus according to claim 7, wherein said injector is provided with means for feeding pressurized air thereto.

9. An apparatus according to claim 3, comprising guide means facilitating the entry of pulverulent product into said chamber through said inlet opening.

10. An apparatus according to claim 9, wherein said guide means comprise a funnel-shaped element, said element being secured to said member in an extension of said inlet opening, so that the diameter of the funnel-shaped element decreases towards said inlet opening.

11. An apparatus according to claim 10, wherein said funnel-shaped element has a conical bore with an apex angle of at most equal to 90°.

12. An apparatus according to claim 11, comprising means automatically feeding said chamber with agglomerates of a pulverulent product.

13. An apparatus according to claim 12, wherein said automatic feeding means comprise a hopper for storing the pulverulent product, said hopper being provided with an outlet opening of adjustable cross section, a stationary frame, resilient suspension means placed between said hopper and said frame, a vibrating element carried by said hopper for vibrating said hopper in a direction favouring the flow of the agglomerates through said outlet opening and vibrating transfer means for conveying the pulverulent fluid flowing out of said outlet opening of said hopper to said inlet opening of said chamber.

14. An apparatus according to claim 13, wherein said transfer means are vibrated by a vibrating element having an adjustable amplitude of vibration.

15. An apparatus according to claim 14, comprising a control element of said vibrating element, capable of actuating the latter exclusively when the value of the pressure within said chamber has decreased to an adjustable predetermined value.

16. An apparatus according to claim 5, wherein said storage chamber means comprises a tank having a lower compartment and an upper compartment separated by a porous wall, said lower compartment having an aperture connected to a source of pressurized gas, and said upper compartment having an inlet orifice communicating with said outlet opening of said member of the treating means, and an outlet orifice, at least a part of the wall of said tank, which delimits the upper compartment being permeable to gas.

17. An apparatus according to claim 16, comprising at least one vibrating element integral with said tank for subjecting the tank to vibrations having a vertical component, and resilient means connecting said tank to a stationary frame.

18. An apparatus according to claim 16, comprising at least one rotary blade driven by a motor and located just above said porous wall.

19. An apparatus according to claim 17, wherein said lower compartment is fed with pressurized air.

20. An apparatus according to claim 19, wherein said means controlling the flow of pulverulent fluid in said conduit comprise in combination a tubular body member connected in series to said conduit, first suction means for causing the pulverulent fluid to flow in a first direction in said conduit, and second suction means for causing the pulverulent fluid to flow in said conduit in a second direction opposed to said first direction.

21. An apparatus according to claim 20, wherein each of said first and second suction means comprises an injector connected to a source of pressurized auxiliary fluid through a distributor, said injector opening inside said tubular body member and causing the auxiliary fluid to flow in a direction corresponding to the direction of flow selected for the pulverulent fluid.

22. An apparatus according to claim 21, wherein each of said injectors comprises an annular space opening in said tubular body member through an annular slot.

23. An apparatus according to claim 22, wherein said annular space is delimited by the wall of a frustro-conical bore provided in said tubular body member and by the conical external wall of a ring located in said tubular body member.

24. An apparatus according to claim 23, comprising a three-way and two-position distributor, whereby exclusively one of either injector may be put in communication with said source of pressurized fluid.

25. An apparatus according to claim 23, wherein said distributor comprises two electrovalves each of which enables a communication to be established between said source of pressurized auxiliary fluid and only one of said two injectors.

26. An apparatus according to claim 25, wherein said electro-valves are controlled in synchronism so that said source of pressurized auxiliary fluid is connected to either injector.

27. An apparatus according to claim 21, for forming with a powder of polytetrafluoroethylene a protective coating on the surface of an object, wherein the injector of said treating means, the lower compartment of said tank and the annular spaces of said control element are fed with pressurized air having a relative humidity at most equal to 50% and a temperature that such that the temperature of the polytetrafluoroethylene in the apparatus does not exceed 19° C.

* * * * *